US006213462B1

(12) United States Patent
Schmidt

(10) Patent No.: US 6,213,462 B1
(45) Date of Patent: Apr. 10, 2001

(54) CHAIN CONVEYOR FOR A SHEET-PROCESSING PRINTING MACHINE; AND A PRINTING MACHINE HAVING THE CHAIN CONVEYOR

(75) Inventor: Thomas Schmidt, Eppelheim (DE)

(73) Assignee: Heidelberger Druckmaschinen Aktiengesellschaft, Heidelberg (DE)

( * ) Notice: Subject to any disclaimer, the term of this patent is extended or adjusted under 35 U.S.C. 154(b) by 0 days.

(21) Appl. No.: 09/344,924

(22) Filed: Jun. 28, 1999

(30) Foreign Application Priority Data

Jun. 26, 1998 (DE) ..... 198 28 573

(51) Int. Cl.[7] ..... B65H 29/04
(52) U.S. Cl. ..... 271/204; 198/838; 198/841
(58) Field of Search ..... 271/204, 217; 198/841, 838

(56) References Cited

U.S. PATENT DOCUMENTS 3,134,322 * 5/1964 Jeschke ..... 271/204
4,780,040 * 10/1988 Petersen ..... 198/841
5,056,773 10/1991 Weisgerber .
5,797,321 * 8/1998 Shibata ..... 271/204

FOREIGN PATENT DOCUMENTS 478362 1/1938 (DE) .
24 36 998 2/1976 (DE) .
39 39 250 C1 12/1990 (DE) .
1 505 681 7/1975 (GB) .

* cited by examiner

*Primary Examiner*—H. Grant Skaggs
(74) *Attorney, Agent, or Firm*—Herbert L. Lerner; Laurence A. Greenberg; Werner H. Stemer

(57) ABSTRACT

A chain conveyor for a sheet-processing printing machine has conveyor chains bearing gripper systems for transporting sheets. The chains are revolvable, during operation, along closed chain tracks having at least substantially circular segment-like chain track sections. A guide rail device is provided for guiding the conveyor chains. A rail section forms part of the guide rail device. The rail section, when loaded by one of the conveyor chains, is deflectable counter to a restoring force and, at a first end of the rail section, adjoins one of the substantially circular segment-like chain track sections. A sheet-processing printing machine having such a chain conveyor is also provided.

10 Claims, 5 Drawing Sheets

CHAIN CONVEYOR FOR A SHEET-PROCESSING PRINTING MACHINE; AND A PRINTING MACHINE HAVING THE CHAIN CONVEYOR

BACKGROUND OF THE INVENTION

FIELD OF THE INVENTION

The invention relates to a chain conveyor for a sheet-processing printing machine having conveyor chains bearing gripper systems for transporting sheets, the chains being revolvable, during operation, along closed chain tracks having at least substantially circular segment-like chain track sections, and a guide rail device for guiding the conveyor chains; the invention also relates to a printing machine equipped with the chain conveyor.

A chain conveyor of the type mentioned in the introduction hereto has become known, for example, from the published German Patent Document DE 39 39 250 C1. A proposed invention therein, wherein the direction of curvature of a chain track remains constant between transfer points on deflection guides, is based upon a solution to the problem that the conveyor chains change from making contact with an outer guide rail to making contact with an inner guide rail or the reverse, respectively, with the production of a great amount of noise, if changes of direction are provided in the chain track. In this regard, a change of direction is obviously understood to mean that the chain track passes through a turning point. However, a further extremely critical region of a chain track is located so that it follows an at least substantially circular segment-like chain track section within which the gripper systems borne by the conveyor chains are subject to relatively high centrifugal forces at the high processing speeds which are common these days in powerful printing machines. These centrifugal forces may result in the gripper bars, which bear the grippers of the gripper systems, being bent radially outwardly relative to the circular segment-like chain track section, the gripper bars then swinging back in the opposite direction when the chain links bearing the gripper systems leave the circular segment-like chain track section and enter a chain track section having a smaller curvature than that of the circular segment-like chain track section, or having a substantially rectilinear course. Consequently, an inner guide rail that follows the circular segment-like chain track section is subject to severe impact impulses from those sections of the conveyor chain which are connected to the gripper systems. Not only does this lead to the production of a great amount of noise, but it also has a considerable wearing effect that causes damage initially to that point on the inner guide rail which is exposed to the impact impulses and, subsequently, also in less highly stressed sections of the guide rails and finally also to the conveyor chains.

Sudden dissipation of the aforementioned centrifugal forces is admittedly already countered by configuring the chain track so that, adjacent to a circular segment-like chain track section, a chain track section is provided having a course initially formed with a greater radius of curvature than that of the circular segment-like chain track section, so that a stepwise reduction in the centrifugal force results.

For the case wherein the circular segment-like chain track section is implemented by a sprocket around which a conveyor chain is wrapped, in order to achieve the aforementioned stepwise reduction in centrifugal force, in the outlet region of the circular segment-like chain track section, the conveyor chain is guided both by the sprocket and by a guide track that is arranged directly alongside the latter and is formed on an inner guide rail, the guide track, as viewed in the direction in which the sprocket revolves, initially running within the root circle of the sprocket and then gradually lifting the chain out of the sprocket. However, during the action wherein the chain is lifted out of the sprocket, the chain rollers of the roller chains which are commonly used in chain conveyors of the foregoing general type are firmly held in the tooth gaps formed in the sprocket while they slide over the guide track effecting the lift-out action. This also leads to wear of guide rails and chain rollers, however.

SUMMARY OF THE INVENTION

It is accordingly an object of the invention to provide a chain conveyor for a sheet-processing printing machine having a longest possible service life.

With the foregoing and other objects in view, there is provided, in accordance with one aspect of the invention, a chain conveyor for a sheet-processing printing machine having conveyor chains bearing gripper systems for transporting sheets, the chains being revolvable, during operation, along closed chain tracks having at least substantially circular segment-like chain track sections, and a guide rail device for guiding the conveyor chains, comprising a rail section forming part of the guide rail device, the rail section, when loaded by one of the conveyor chains, being deflectable counter to a restoring force and, at a first end of the rail section, adjoining one of the substantially circular segment-like chain track sections.

In accordance with another feature of the invention, the chain conveyor includes an integral connection of the rail section, at a second end thereof facing away from the first end thereof, to a further rail section following the second end of the first-mentioned rail section, the integral connection being a nominal bending point.

In accordance with a further feature of the invention, the chain conveyor includes an articulating connection of the rail section, at a second end thereof facing away from the first end thereof, with a further rail section following the second end of the first-mentioned rail section.

In accordance with an added feature of the invention, the chain conveyor includes a shock-absorber arrangement for acting upon the rail section.

In accordance with an additional feature of the invention, the shock-absorber arrangement has a damping action that is adjustable.

In accordance with a concomitant aspect of the invention, there is provided a sheet-processing printing machine having a chain conveyor having at least one of the foregoing features.

Accordingly, impact forces resulting from the aforementioned impact impulses are reduced. One embodiment of the invention is distinguished by a shock-absorber arrangement acting upon the rail section. The thereby achieved damping of the inherent vibrations of the chain conveyor which are excited by the impact impulses results in the production of less noise than in conventional chain conveyors.

A preferred embodiment is distinguished by an integral connection of the rail section, at a second end facing away from the first end of the rail section, to a further rail section following the second end, and constructing the integral connection as a nominal or desired bending point.

Another preferred refinement provides for an articulating connection of the rail section, at a second end facing away from the first end of the rail section, to a further rail section following the second end.

In a further construction, a shock-absorber arrangement is provided in which the damping action is adjustable. This results in the further advantage that the damping can be adapted to the speed with which the conveyor chains revolve. To this end, the damping is increased as the speed increases.

Other features which are considered as characteristic for the invention are set forth in the appended claims.

Although the invention is illustrated and described herein as embodied in a chain conveyor for a sheet-processing printing machine, and a printing machine having the chain conveyor, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

In principle, the chain conveyor can be used anywhere in a sheet-processing printing machine where the sheets are not transported by drums or cylinders. In the following text, therefore, the provision of the chain conveyor in a chain delivery of a sheet-processing printing machine should be considered to be merely by way of example.

Figure 1:
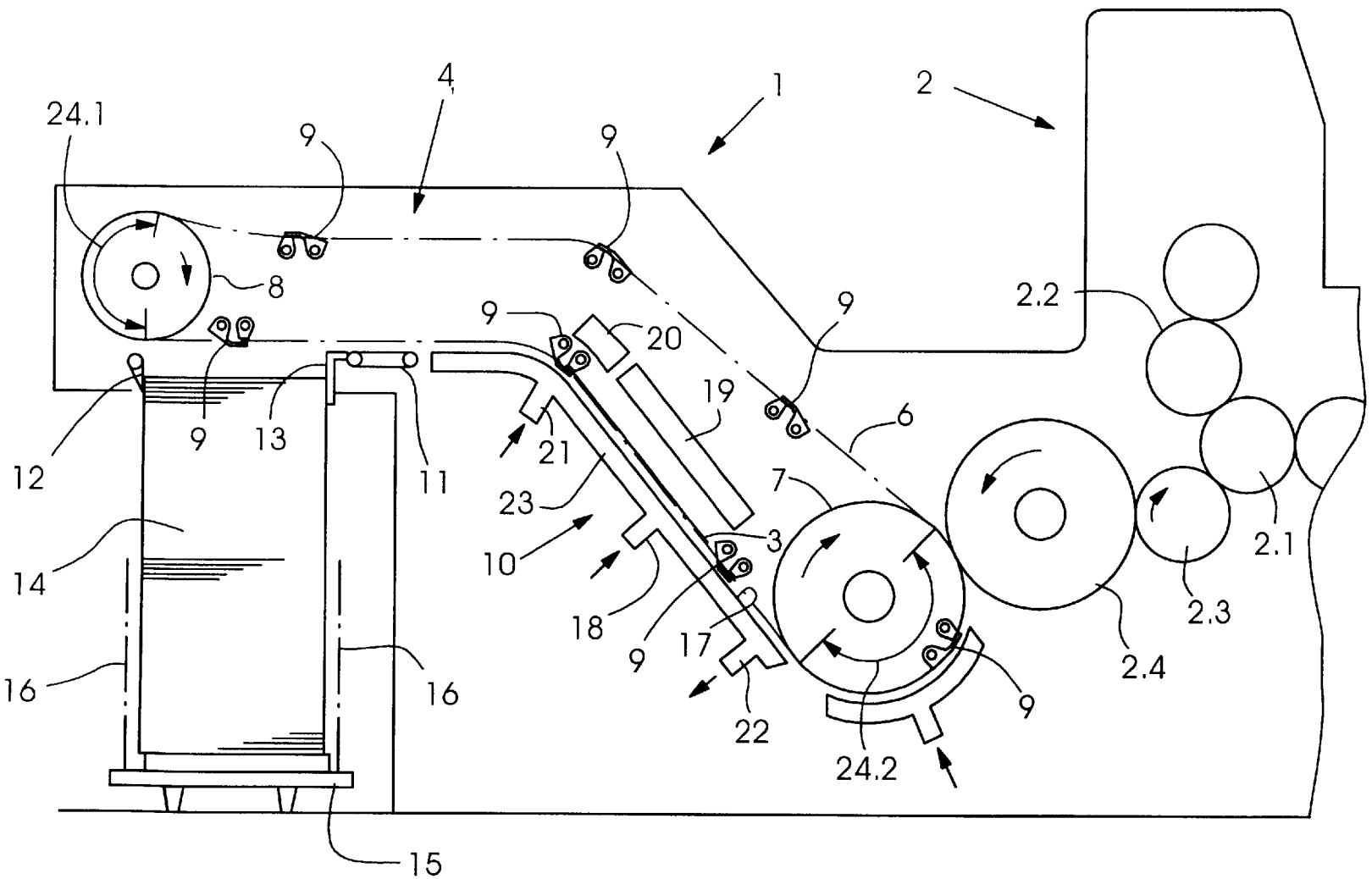
FIG. 1 is a fragmentary diagrammatic side elevational view of a sheet-processing printing machine including a chain conveyor according to the invention.

Referring now more specifically to the drawings and, first, particularly to FIG. 1 thereof, there is shown therein a chain delivery 1 following a last processing station of the printing machine. Such a processing station may be a printing unit or a post-treatment unit, such as a varnishing unit, for example. In the example at hand, the last processing station is a printing unit 2, operating in accordance with the offset process, the printing unit 2 having an impression cylinder 2.1. The latter conveys a respective sheet 3 in a processing direction through a printing nip between the impression cylinder 2.1 and a blanket cylinder 2.2 co-operating with the latter and, in the illustrated embodiment, subsequently transfers the sheet 3 to a row of grippers of a single-revolution transfer drum 2.3, while grippers of a row thereof arranged on the impression cylinder 2.1 and provided for gripping the sheet 3 at a gripper edge at the leading end of the sheet 3 are opened. A corresponding transfer of the sheet 3 then takes place from the single-revolution transfer drum 2.3 to a further transfer drum 2.4 (a half-revolution drum in the example at hand), which finally transfers the sheet 3 to a chain conveyor 4. The latter includes two endless conveyor chains 6, a respective one of which, when operating, revolving along a closed chain track in the vicinity of a respective side wall of the chain delivery 1. A respective conveyor chain 6 in each case wraps around one of two synchronously driven drive sprockets 7 having axes of rotation which are aligned with one another and, in the example at hand, is guided over a respective deflecting or turn sprocket 8 which, in relation to the drive sprockets 7, is located downline with regard to the processing direction, so that each of the conveyor chains 6 runs through a closed chain track. Between the two conveyor chains 6, there extend gripper systems 9 which are borne by the conveyor chains and have grippers, which move through gaps between the grippers arranged on the transfer drum 2.4 and, in so doing, take over a respective sheet 3, by gripping the aforementioned gripper edge at the leading end of the sheet 3, immediately before the opening of the grippers arranged on the transfer drum 2.4, transport the sheet over a sheet guide device 10 to a sheet brake 11, and open at that location in order to transfer the sheet 3 to the sheet brake 11. The latter imparts to the sheets a depositing speed which is lower in comparison with the processing speed, and, after reaching the depositing speed, in turn releases the sheets, so that a respective sheet 3 which has now been slowed down finally strikes leading-edge stops 12 and, while being aligned with the latter and with trailing-edge stops 13 located opposite thereto, together with preceding and/or subsequent sheets 3, forms a sheet pile 14 which can be lowered by a lifting mechanism to an extent dependent upon the growth of the sheet pile 14. The only members of the lifting mechanism which are reproduced in FIG. 1 are a platform 15 carrying the sheet pile 14, and lifting chains 16, indicated in phantom, i.e., by dot-dash lines, which bear the platform 15.

The conveyor chains 6, along the paths thereof between the drive sprockets 7, on the one hand, and the deflecting or turn sprockets 8, on the other hand, are guided by chain guide rails, which thus determine the chain tracks of the chain runs. In the illustrated embodiment of FIG. 1, the sheets 3 are transported by the lower chain run. That section of the chain track through which this lower chain run passes is followed by a sheet guide surface 17 formed on the sheet guide device 10 and facing towards the lower chain run. During operation, a carrying-air cushion is preferably formed between the sheet guide surface 17 and the sheet 3, respectively guided thereover. To this end, the sheet guide device 10 is equipped with blast or blown-air nozzles terminating at the sheet guide surface 17, the blown-air nozzles being represented symbolically by only one nozzle 18 in FIG. 1.

In order to prevent the printed sheets 3 in the sheet pile 14 from sticking to one another, a dryer 19 and a powder sprayer 20 are provided on the path of the sheets 3 from the drive sprockets 7 to the sheet brake 11.

In order to avoid excessive heating of the sheet guide surface 17 by the dryer, a coolant circuit is integrated into the sheet guide device 10 and is indicated symbolically in FIG. 1 by an inlet nozzle 21 and an outlet nozzle 22 on a coolant trough 23 assigned to the sheet guide surface 17.

The illustration of the aforementioned chain guide rails has been omitted from FIG. 1. However, the course thereof in the embodiment illustrated in FIG. 1 can be seen from the course of the chain runs therein.

In the example at hand, circular segment-like chain track sections 24.1 and 24.2 are formed, in particular, by those sections of the drive sprockets 7 and of the turn sprockets 8 around which the conveyor chains 6 wrap.

Figure 2:
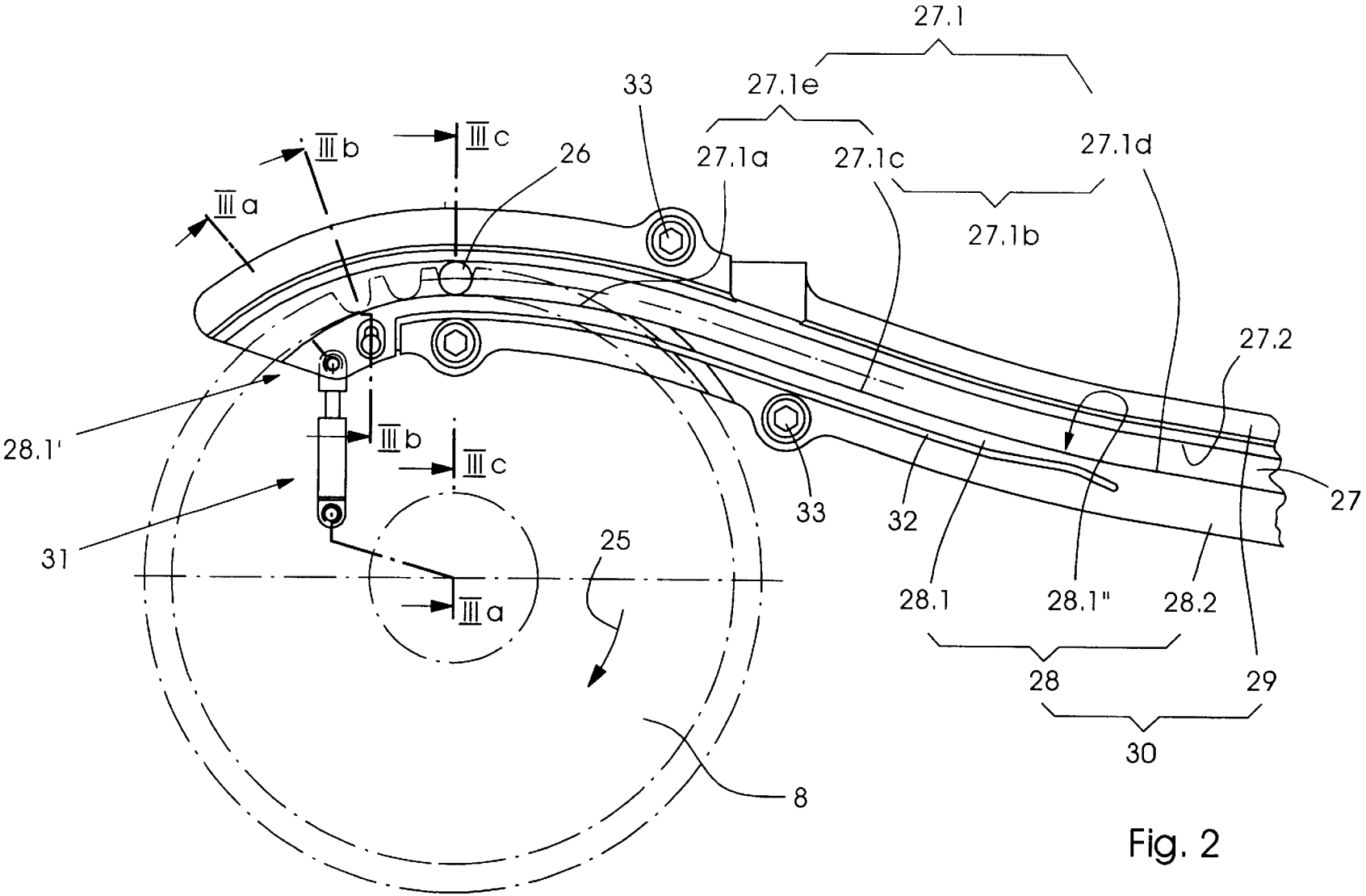
FIG. 2 is an enlarged fragmentary view of FIG. 1 showing a first embodiment of the chain conveyor in detail.

The detail taken from FIG. 1 and illustrated in FIG. 2 shows, in phantom, a respective one of the deflecting or turn sprockets 8 around which a respective one of the conveyor chains 6 (not shown in FIG. 2) partially wraps, in accordance with FIG. 1, the deflecting or turn sprocket 8, during operation, rotating in the direction of rotation indicated by the directional arrow 25 if the conveyor chains 6 are driven in a clockwise revolving direction, as assumed here. As mentioned hereinbefore, the conveyor chains 6 are normally formed as roller chains. In FIG. 2, an appropriate chain roller 26 is illustrated as a representative thereof, specifically at a location at which, due to the indicated direction of rotation of the deflecting or turn sprocket 8, the chain roller 26 has almost completely passed through the circular segment-like chain track section 24.1 indicated in FIG. 1, and has already entered a guide gap 27 between an inner guide rail 28 and an outer guide rail 29 of a guide rail arrangement 30. Because the circular segment-like chain track section 24.1 is formed by the deflecting or turn sprocket 8, it is possible at least to dispense with the arrangement of an inner guide rail in this chain track section 24.1, apart from transition regions in the form of an outlet region, and an inlet region that is not otherwise specifically shown in FIG. 2. For this reason, in the embodiment as shown in FIG. 2, the inner guide rail 28 is also interrupted between the inlet region and the outlet region. Furthermore, in this embodiment, the outer guide rail 29 is also interrupted between the inlet region and the outlet region.

Respective guide tracks 27.1 and 27.2 for the chain rollers are formed on the inner and the outer guide rail 28 and 29, respectively, and serve to define or bound the guide gap 27. In a manner like that of the outer guide track 27.2, the inner guide track 27.1 also has a track width that matches the length of the chain rollers 26, except for sections of the guide track along which it runs laterally of the deflecting or turn sprocket 8 and the drive sprocket 7, respectively, and here includes the aforementioned transition regions. In each of the aforementioned transition regions, respectively, of the chain track, there are conditions which differ from the foregoing. These are apparent from the example of the outlet region of the chain track section 24.1, in particular, in FIGS. 3*a* to 3*c* and 4*b*. In the aforementioned outlet region, the inner guide rail 28 (here extending along part of a rail section 28.1 having a further course that is described in greater detail) is narrowed by at least the thickness of the toothed rim 8.1 of the turn sprocket 8, and here has an appropriately narrowed section 27.1*a* of the inner guide track 27.1, so that a respective chain roller 26, as indicated in FIG. 3*c*, extends across the narrowed section 27.1*a* of the inner guide track 27.1 and across the thickness of the toothed rim 8.1.

As mentioned hereinbefore, in the embodiment at hand, the inner guide rail 28 and the outer guide rail 29 are interrupted between the inlet region and the outlet region of the chain track section 24.1, so that a respective chain roller 26 that is initially guided exclusively by the deflecting or turn sprocket 8 is introduced into the guide gap 27 by the deflecting or turn sprocket 8 in the outlet region of the chain track section 24.1. In order to ensure that a respective chain roller 26 runs into the guide gap 27 reliably and without any shock, this guide gap 27, which is otherwise matched to the diameter of the chain roller 26, is widened in a spiral shape along an entry region of the gap 27 and, starting from that end of the entry region which is upstream in relation to the direction in which the conveyor chains 6 revolve, is tapered along the entry region until it reaches a dimension matching the diameter of the chain rollers 26. The aforementioned upstream end of the entry region is assigned to the circular segment-like chain track section 24.1 so that a respective chain roller 26 has already entered the widened entry region of the guide gap 27 while it is still being guided on a circular segment-like chain track by the deflecting or turn sprocket 8.

The guide gap 27 which includes the entry region is bounded on one side by the outer guide track 27.2 and, in the embodiment at hand, is bounded on the other side by a narrowed section 27.1*a* of the inner guide track 27.1 which includes the aforementioned outlet region, and by a section 27.1*b* of the inner guide track 27.1 that adjoins this section 27.1*a* and is of full width. The narrowed section 27.1*a* of the inner guide track 27.1 and an adjacent first portion 27.1*c* of the full-width section 27.1*b* of the inner guide track 27.1 together form a section 27.1*e*, which is adjoined, as viewed in the revolving direction of the conveyor chains that is determined by the direction-of-rotation arrow 25, by a further portion 27.1*d* of the full-width section 27.1*b* of the inner guide track 27.1. In the embodiment at hand, a deflectable rail section 28.1 is provided for forming the aforementioned section 27.1*e* of the inner guide track 27.1.

There results altogether therefrom, for a first end 28.1' of this rail section 28.1 that faces the circular segment-like chain track section 24.1, that this first end 28.1', as viewed in the direction of rotation of the deflecting or turn sprocket 8 that is indicated by the directional arrow 25, forms the beginning of the aforementioned outlet region, i.e., that this first end 28.1' adjoins the circular segment-like chain track section 24.1.

The section 27.1*e* of the inner guide track 27.1 that is formed on the rail section 28.1 initially runs, in the form of the narrowed section 27.1*a* in the aforementioned spirally widened entry region, within the root circle of the deflecting or turn sprocket 8, thereby continuously approaches the root circle, as viewed in the revolving direction of the conveyor chains 6, also, in the further course thereof, emerges above the addendum or crown circle of the deflecting or turn sprocket 8 and subsequently merges into the full-width section 27.1*c*, which extends as far as a second end 28.1", facing away from the first end 28.1', of the rail section 28.1. To this extent, a section 27.1*e* of the inner guide track 27.1, this section 27.1*e* following the circular segment-like chain track section 24.1, is formed on the rail section 28.1.

In the example at hand, the rail section 28.1 is supported in the region of the first end 28.1' thereof by a shock-absorber arrangement 31 and, in addition, is designed in such a way, and is connected to a further rail section 28.2 of the inner guide rail 28, this section adjoining the second end 28.1" of the same, in such a way that the rail section 28.1 can be deflected counter to a restoring force when loaded by one of the conveyor chains 6. In this regard, provision is made for the rail section 28.1, besides the support thereof by the shock-absorber arrangement 31, to have only one further support at the second end 28.1" of the rail section 28.1. In a first improved embodiment that is apparent from FIGS. 2 to 25 3*c*, this further support is implemented by a single-piece connection, representing an intended bending point, of the second end 28.1" of the rail section 28.1 to the further rail section 28.2 of the inner guide rail 28. The second end 28.1" of the rail section 28.1, and an end of the further rail section 28.2 connected integrally thereto are formed with a cross section that is smaller than the remaining regions of the rail section 28.1 and the further rail section 28.2, in order to form the nominal or desired bending point at the location of the integral connection.

In this improved embodiment, the deflection of the rail section 28.1 therefore occurs together with the bending of the rail section 28.1 in the elastic region, this bending occurring in particular at the nominal bending point, so that, thereby, a restoring force that counteracts the deflection can be produced by the rail section 28.1. The restoring force can also be increased by additionally providing a herein non-illustrated spring arrangement.

Figure 3A:
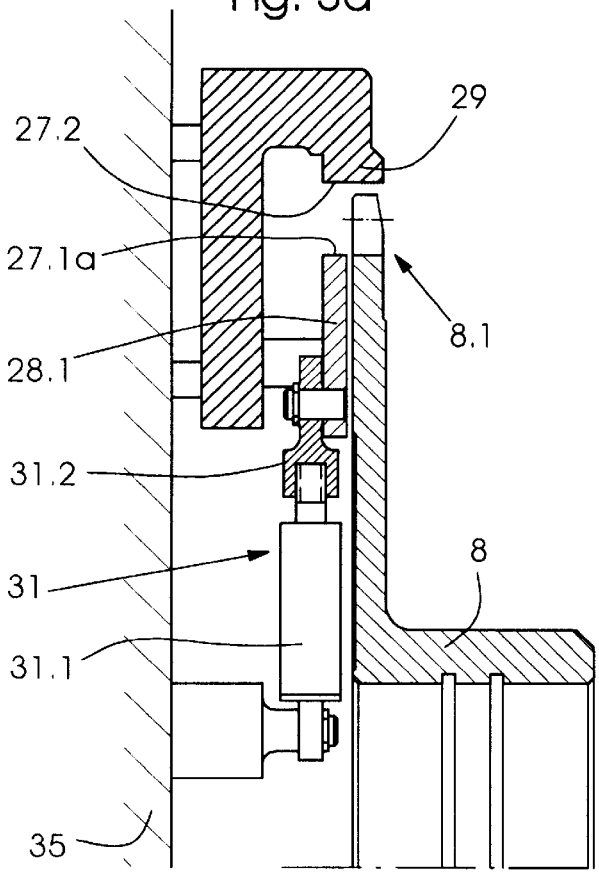
FIGS. 3*a* to 3*c* are fragmentary enlarged cross-sectional views of FIG. 2 taken along the respective lines IIIa, IIIb and IIIc in the direction of the respective arrows.
Figure 3B:
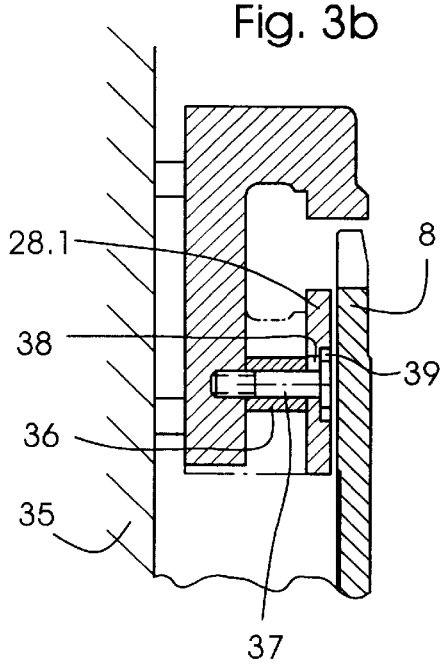
Figure 3C:
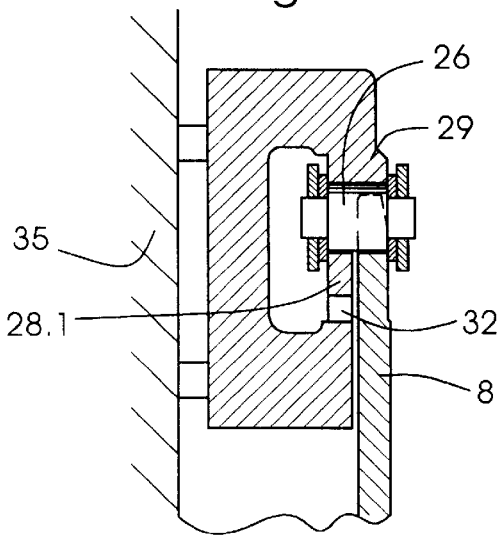

For the heretofore-described structural configuration of the rail section 28.1, in a first example according to FIGS. 2 to 3*c*, a guide rail arrangement 30 is formed by a profiled rail with a C-shaped cross section that is most apparent from FIG. 3*c*. In this regard, the inner guide track 27.1 and the outer guide track 27.2 are formed on mutually facing webs of the profiled rail. The web forming the inner guide track 27.1 is separated from the rear of the C-shaped profiled rail in a section of the web which is associated with the aforementioned entry region, as can be seen in particular in FIGS. 3*a* and 3*b*. A cross-sectional area that has been removed from the profiled rail for this purpose is marked in FIG. 3*b* by dot-dash lines. The aforementioned section separated from the rear of the C-shaped profiled rail is further cut free by a slit 32 which passes through the aforementioned web. Starting from the separated section, this slit extends, as viewed in the direction wherein the conveyor chains 6 revolve, to a starting region of the further rail section 28.2, at the same time essentially follows the course of the section 27.1*e* of the inner guide track 27.1 and, together with the aforementioned cross-sectional area outlined in FIG. 3*b* by dot-dash lines and removed from the C-shaped cross section of the profiled rail, cuts the rail section 28.1 free as far as the integral connection thereof to the further rail section 28.2 of the guide rail arrangement 30. In an end region of the slit 32 that faces the further rail section 28.2, the slit 32 approaches this section 27.1*e* of the inner guide track 27.1 that is formed on the rail section 28.1, until it reaches the second end 28.1" of the rail section 28.1, while an end section of the slit 32 that extends into the further rail section 28.2 moves away from the inner guide track 27.1 again, so that the result, at the second end 28.1" of the rail section 28.1, is a nominal or desired bending point in the form of a reduced cross section of the rail section 28.1.

In order to form the shock-absorber arrangement 31, use can be made, for example, of a short-stroke shock absorber of the ADA type from the company Enidine GmbH, located at Weil am Rhein in Germany.

The aforedescribed structural configuration advantageously provides a limitation to the maximum deflection of the rail section 28.1, which occurs when it is loaded or stressed by one of the conveyor chains, to the clear width of the slit 32, because, in particular, a part of the profiled rail forming the guide rail arrangement 30, namely the part thereof remaining underneath the slit 32 in FIG. 2, is also permanently connected to a side wall of the delivery, specifically by the screw connections 33 in the example according to FIG. 2.

Figures 4, 4A:
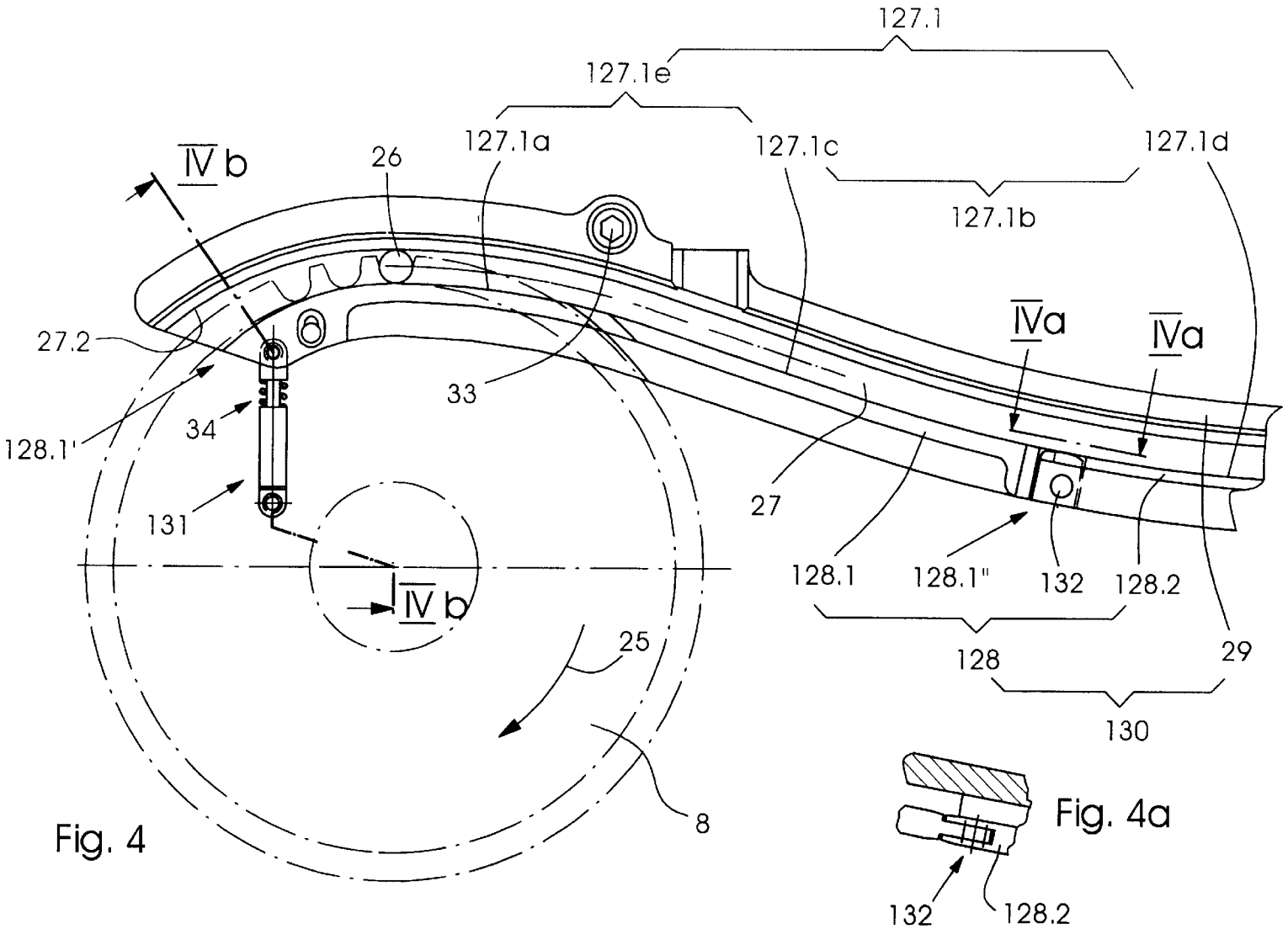
FIG. 4 is a detailed view like that of FIG. 2 of a second embodiment of the chain conveyor.
FIGS. 4*a* and 4*b* are fragmentary enlarged cross-sectional views of FIG. 4 taken along the respective lines IVa and IVb in the direction of the respective arrows.
Figure 4B:
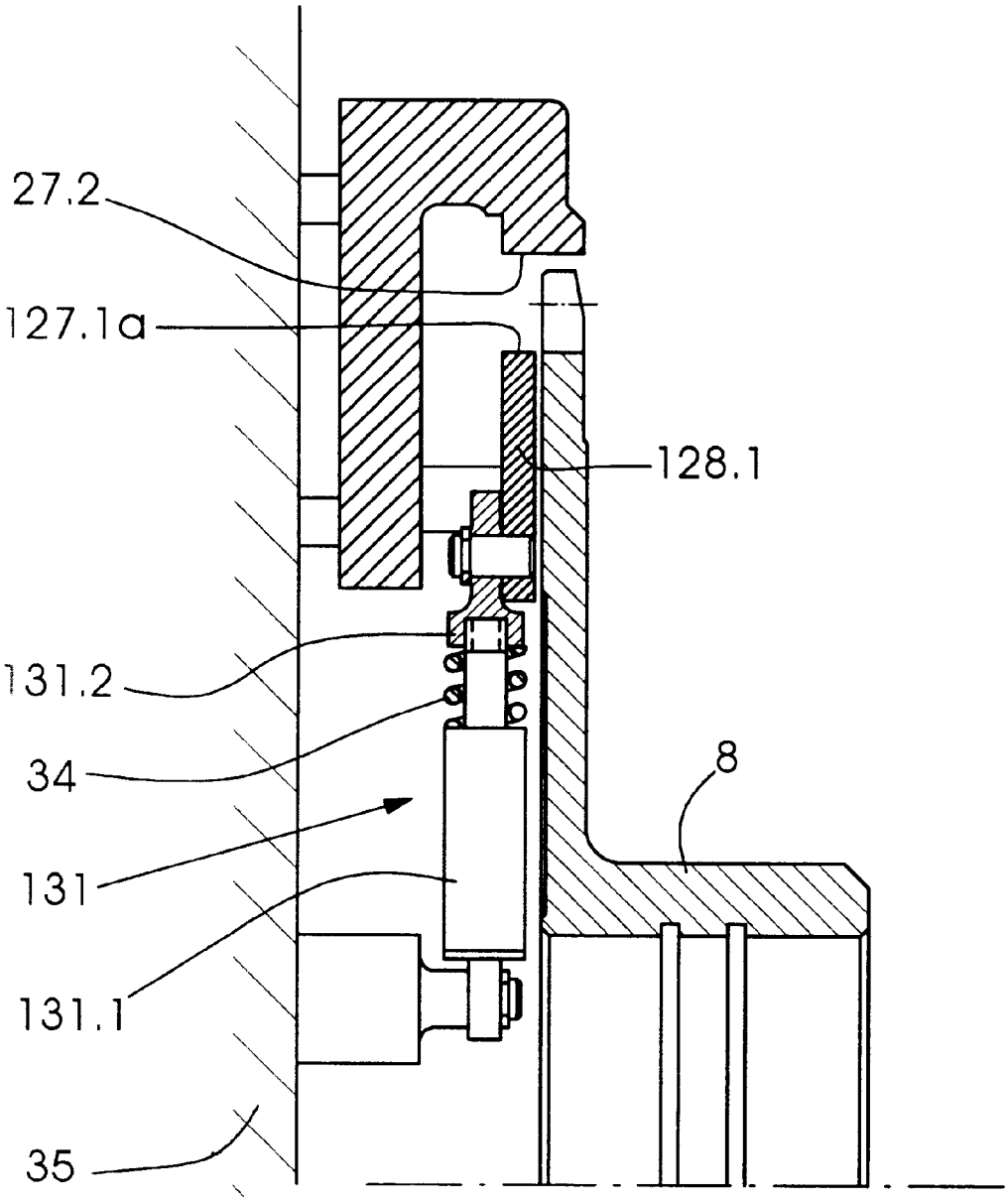

FIG. 4 again illustrates a detail from FIG. 1, corresponding to that of FIG. 2, in a different embodiment of the chain conveyor 4, wherein the further support provided in addition to the support by a shock-absorber arrangement is for a rail section 128.1 that follows one of the substantially circular segment-like chain track sections 24.1, and can be deflected when loaded by one of the conveyor chains 6, by an articulating or hinged connection 132 of the rail section 128.1, at a second end 128.1" facing away from the first end 128.1' thereof, to a further rail section 128.2 that follows the second end 128.1". Because, in this case, a restoring force which counteracts the deflection of the rail section 128.1 is not produced by elastic deformation of the rail section 128.1, as in the case of the aforedescribed embodiment, a spring arrangement 34 acting upon the rail section 128.1 is provided in order to furnish the restoring force. In other respects, however, the exemplary embodiments of the chain conveyor 4 illustrated on the one hand in FIG. 2 and on the other hand in FIG. 4 are identical. In particular, the guide gap 27 has the same course and the same geometry in the entry region thereof and in the further course thereof, and a first end 128.1' of the rail section 128.1, this end being assigned to the circular segment-like chain track section 24.1, is supported by a shock-absorber arrangement 131.

In the embodiment according to FIG. 4, the circular segment-like chain track section 24.1 is again implemented by the deflecting or turn sprocket 8. Consequently, an inner guide track 127.1 likewise has a section 127.1*a* with a narrowed width that includes the outlet region. This is likewise followed by a first portion 127.1*c* of a full-width section 127.1*b* of the inner guide track 127.1, that is then followed by a further portion 127.1*d* of the full-width section 127.1*b* of the inner guide track 127.1. The narrowed section 127.1*a* and the first full-width portion 127.1*c* together form a section 127.1*e* of the inner guide track 127.1, that is followed, as viewed in the revolving direction of the conveyor chains, by a further portion 127.1*d* of the full-width section 127.1*b* of the inner guide track 127.1.

In the exemplary embodiment according to FIG. 4, once again a deflectable rail section 128.1 is provided for forming the aforementioned section 127.1*e* of the inner guide track 127.1, this section 127.1*e* extending from a first end 128.1', assigned to the circular segment-like chain track section 24.1, of the rail section 128.1 as far as the second end 128.1" of the latter, at which the rail section 128.1 is supported by an articulating or hinged connection 132 on a further rail section 128.2 of the inner guide rail 128 which follows the second end 128.1" and forms the further portion 127.1*d*. The articulating or hinged connection 132 is formed so that the rail section 128.1 can be pivoted with reference to the geometrical pivot axis of the articulating or hinged connection 132, in particular when it is loaded or stressed by one of the conveyor chains 6.

The spring arrangement 34 that opposes this deflection with a restoring force is implemented in the instant exemplary embodiment by a helical spring that, at one end thereof, is supported on a cylinder and, at the other end thereof, is supported on a piston-rod head of the shock-absorber arrangement 131, that is formed as a piston/cylinder unit.

For the structural configuration of the aforedescribed rail section 128.1, once more, a guide rail arrangement 130 corresponding to the configuration described at the introduction hereto and formed as a profiled rail with a C-shaped cross section is provided to support the rail section by the articulating or hinged connection 132. In this regard, however, only an outer web of the profiled rail, the web forming the outer guide track 27.2, extends as far as the entry to the aforementioned spirally widened entry region of the guide gap 27, whereas the inner web, located opposite the outer web, together with the connection thereof to the rear of the C-shaped cross section of the profiled rail, is removed and replaced by the rail section 128.1, starting from the entry into the entry region and extending over a length of the profiled rail corresponding to the section 127.1*e* of the inner guide track 127.1.

In the region of the articulating or hinged connection 132 of the rail section 128.1, there is formed a tongue, which can be seen in FIG. 4*a* and is similar to a tongue-and-groove connection, that engages in a corresponding groove formed in the further rail section 128.2, so that a pivoting movement of the rail section 128.1 is possible with reference to the pivot axis of a hinge pin that passes through the groove and the tongue, transversely to the revolving direction of the conveyor chains 6. The edges of the rail section 128.1 and of the further rail section 128.2 are beveled or rounded in the region of the hinged connection 132, so that a respective chain roller 26 rolls over the hinged connection 132 as far as possible, free of any shock or impact.

In the exemplary embodiment according to FIG. 4, the articulating or hinged connection 132 is preferably provided in a track section of the chain guide track wherein the chain rollers 26 are pressed against the outer guide track 27.2.

In the two aforedescribed embodiments, the shock-absorber arrangement 31 or 131, respectively, is in each case formed, by way of example, as a piston/cylinder unit. The respective cylinder 31.1 or 131.1, respectively, has an articulating or hinged connection to a side wall 35 of the chain delivery 1, this side wall carrying the guide rail arrangement 30 or 130, respectively, and the respective piston-rod head 31.2 or 131.2 has an articulating or hinged connection to the first end 28.1' or 128.1', respectively, of the rail section 28.1 or 128.1, respectively.

In the case of the embodiment having the articulating or hinged connection 132 of the rail section 128.1 to the further rail section 128.2, in order to form the shock-absorber arrangement 131, use may be made, for example, of a short-stroke shock absorber of the OEM type from the company Enidine GmbH, Weil am Rhein, Germany.

Regardless of the type of embodiment, in order to form the shock-absorber arrangement 31 or 131, respectively, use is preferably made of a shock absorber wherein the damping action is adjustable. A shock absorber suitable therefor is, for example, a short-stroke shock absorber of the ADA type from the company Enidine GmbH, Weil am Rhein, Germany. The adjustability of the damping is preferably used to provide increased damping with an increased revolving speed of the conveyor chains 6.

A further common factor in the constructive implementations of the deflectable rail sections 28.1 and 128.1, respectively, in accordance with the two described embodiments is the lateral guidance of the rail sections 28.1 and 128.1, respectively. An exemplary embodiment of this for the case of the construction according to FIG. 2 can be seen from this figure in conjunction with FIG. 3b. The lateral guidance is provided in the vicinity of the articulation of the shock-absorber arrangement 31 or 131, respectively, i.e., in the region of the first end 28.1' or 128.1', respectively, of the rail section 28.1 or 128.1, respectively, and in the example at hand is implemented as follows:

The interspace between the rear of the profiled rail of C-shaped cross section which is used to form the guide rail arrangement 30, and that side surface of the rail section 28.1 which faces away from the deflecting or turn sprocket 8 is bridged by a spacer sleeve 36 that is carried by a shouldered bolt 37 fastened to the rear of the profiled rail. The shouldered bolt 37 passes through a slot 38 formed in the rail section 28.1, the slot 38 being oriented in the direction in which the rail section 28.1 is deflected. Machined into the side of the rail section 28.1 which faces the deflecting or turn sprocket 8 is a shoulder 39 that accommodates the shoulder on the shouldered bolt 37 and is dimensioned so that deflection of the rail section 28.1 is possible without any impedance thereof by the aforementioned shoulder 39. The rail section 28.1 is therefore guided laterally by that end of the spacer sleeve 36 which faces it and by the shoulder on the shouldered bolt 37 which engages over the width of the slot 38.

I claim:

1. A chain conveyor for a sheet-processing printing machine having conveyor chains bearing gripper systems for transporting sheets, the chains being revolvable, during operation, along closed chain tracks having at least substantially circular segment-like chain track sections, and a guide rail device for guiding the conveyor chains, comprising a rail section forming part of the guide rail device, said rail section, when loaded by one of the conveyor chains, being deflectable counter to a restoring force and, at a first end of said rail section, adjoining one of the substantially circular segment-like chain track sections.

2. The chain conveyor according to claim 1, including a shock-absorber arrangement for acting upon said rail section.

3. The chain conveyor according to claim 2, wherein said shock-absorber arrangement has a damping action that is adjustable.

4. In combination with a sheet-processing printing machine, a chain conveyor according to claim 1.

5. A chain conveyor for a sheet-processing printing machine having conveyor chains bearing gripper systems for transporting sheets, the chains being revolvable, during operation, along closed chain tracks having at least substantially circular segment-like chain track sections, and a guide rail device for guiding the conveyor chains, comprising:

a rail section forming part of the guide rail device, said rail section, when loaded by one of the conveyor chains, being deflectable counter to a restoring force and, at a first end of said rail section, adjoining one of the substantially circular segment-like chain track sections, said rail section having an integral connection at a second end thereof facing away from said first end thereof, to a further rail section following said second end of said first-mentioned rail section, said integral connection being a nominal bending point.

6. The chain conveyor according to claim 5, including a shock-absorber arrangement for acting upon said rail section.

7. In combination with a sheet-processing printing machine, a chain conveyor according to claim 5.

8. A chain conveyor for a sheet-processing printing machine having conveyor chains bearing gripper systems for transporting sheets, the chains being revolvable, during operation, along closed chain tracks having at least substantially circular segment-like chain track sections, and guide rail device for guiding the conveyor chains, comprising:

a rail section forming part of the guide rail device, said rail section, when loaded by one of the conveyor chains, being deflectable counter to a restoring force and, at a first end of said rail section, adjoining one of the substantially circular segment-like chain track sections, said rail section having an articulating connection at a second end thereof facing away from said first end thereof, with a further rail section following said second end of said first-mentioned rail section.

9. The chain conveyor according to claim 8, including a shock-absorber arrangement for acting upon said rail section.

10. In combination with a sheet-processing printing machine, a chain conveyor according to claim 8.

* * * * *